United States Patent [19]

See

[11] 4,169,339

[45] Oct. 2, 1979

[54] PLATE FOR GRATING AND GRATING RESULTING THEREFROM

[75] Inventor: Jacques L. A. See, Neuilly-sur-Seine, France

[73] Assignee: Substratum S.A., Luxembourg

[21] Appl. No.: 873,948

[22] Filed: Jan. 31, 1978

[30] Foreign Application Priority Data

Jan. 31, 1977 [FR] France ..... 77 02641
Apr. 29, 1977 [FR] France ..... 77 12992

[51] Int. Cl.[2] ..... B32B 3/00; E04C 2/42

[52] U.S. Cl. ..... 52/177; 52/660; 52/581; 52/309.1; 428/53; 428/58; 428/174; 428/597; 428/603

[58] Field of Search ..... 428/53, 58, 174, 179, 428/180, 603, 604, 116, 119, 582, 597, 577; 238/14; 52/581, 583, 660, 663, 177, 180, 670–674, 309.1; 404/36, 40

[56] References Cited

U.S. PATENT DOCUMENTS

| | | | |
|---|---|---|---|
| 2,377,211 | 5/1945 | Cocken, Jr. | 52/582 |
| 2,434,232 | 1/1948 | Singleton | 52/674 |

*Primary Examiner*—George F. Lesmes
*Assistant Examiner*—P. Thibodeau
*Attorney, Agent, or Firm*—Browdy and Neimark

[57] ABSTRACT

A grating plate includes a succession of opposed symmetrical pyramids having arms connected at their tops with wax-drop shaped reinforcing elements. Fixing means are provided on the sides for connecting a plurality of grating plates together.

16 Claims, 9 Drawing Figures

PLATE FOR GRATING AND GRATING RESULTING THEREFROM

BACKGROUND OF THE INVENTION

The present invention relates to a kind of plate for the construction of gratings. By the term "grating", it should be understood ground-layers of any sizes, for example of some square decimeters to a plurality of hundreds of square meters. Actually, the plates of the invention can be used in a great many applications including such diverse applications as bath-carpets, running paths, and ground reinforcing networks, in the last plate or plates made the grating may simply be placed and possibly completely buried for making a kind of armature.

The grating according to the invention can also be used as sliding track or as an anti-skidding surface.

SUMMARY OF THE INVENTION

The grating plates made according to the invention advantageously have a very small weight, and can very easily be made by moulding, thermosforming or stamping of various synthetic materials and, possibly, of metal, for example, of iron sheets, of aluminium alloy materials, etc. Assembling of the plates does not necessitate any tools and or require skilled people. When the plates are made of a flexible material, they can easily conform to the uneveness of a ground, which still facilitates their use.

For some applications, the plates can be manufactured of a bio-degradable material, which enables one to use them for the reinforcement of loose or moving soil untill such soil becomes consolidated by growing of plants.

According to the invention, the plate and the grating formed by one or more of the plates is characterized in that the plate comprises an assembly according to orthogonal lines and rows of pyramidal elements formed by thin arms, these arms having tops connected by a reinforcing part shaped as a wax drop, bottom of the arms being connected to bottoms of adjacent pyramidal elements. The pyramidal elements are symmetrically formed on both sides of each plate, the lateral walls of which are provided with means for assembling with other plates.

Various other features of the invention are further set out in the following disclosure.

BRIEF DESCRIPTION OF THE DRAWINGS

Embodiments of the invention are shown as non limitative examples in the accompanying drawings wherein.

DESCRIPTION OF THE PREFERRED EMBODIMENTS

The grating according to the invention is made by assembling together a plurality of plates 1 which, preferably, are each in the shape of a square.

Figures 1, 2, 3, 4:
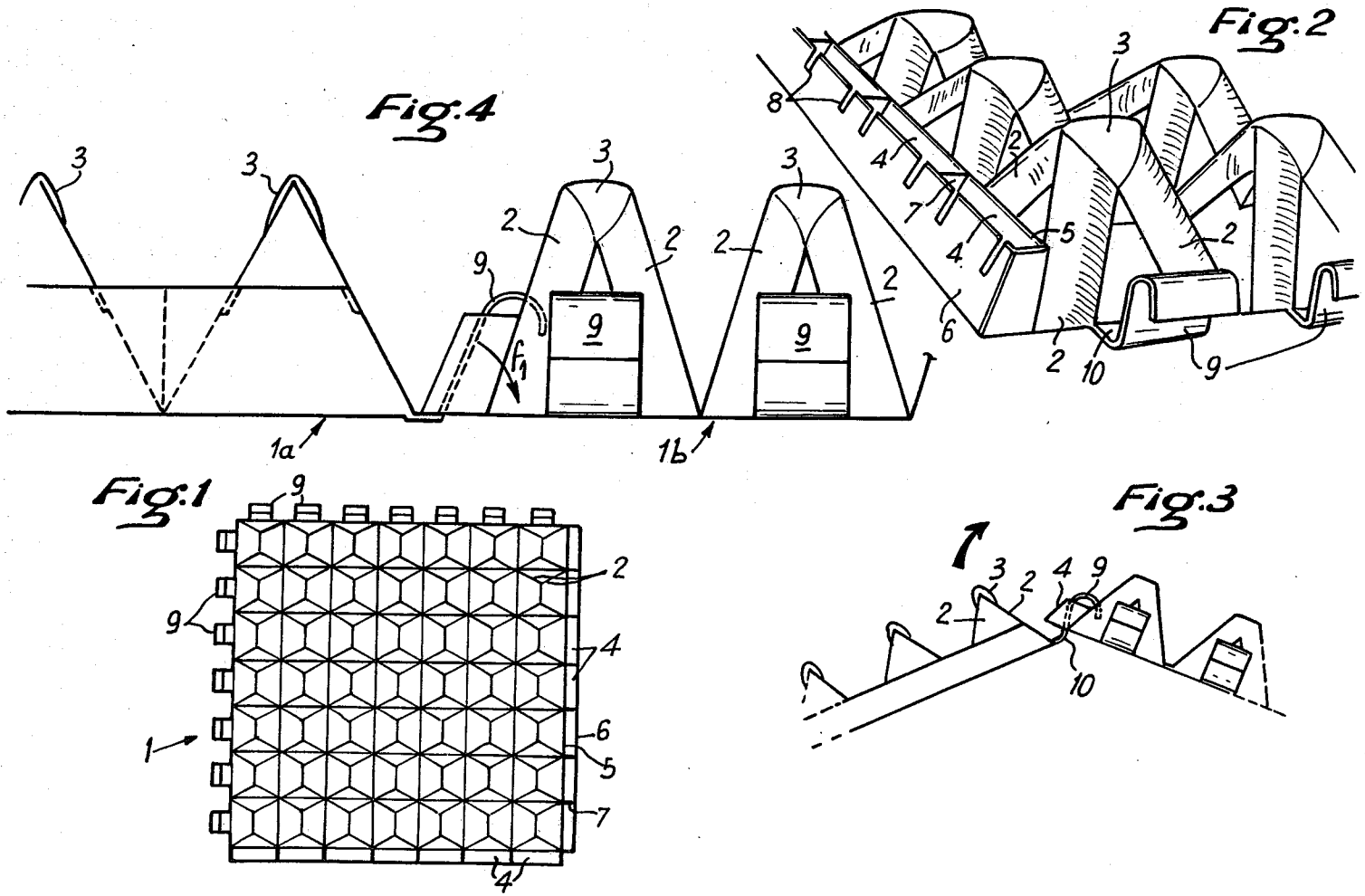
FIG. 1 is a diagrammatic top plane view of a plate which with other such plates constitutes a grating according to the invention.
FIG. 2 is an enlarged partial perspective view showing a corner angle of the plate of FIG. 1.
FIG. 3 is a diagram explicating the mounting of two adjacent plates, in accordance with the present invention.
FIG. 4 is a partial side elevation view of two adjacent plates when they are assembled.

FIGS. 1 and 2 show that each plate is formed by assembling according to orthogonal lines and rows of four-armed elementary pyramids. The arms 2 of each pyramid have a preferably arcuate cross-section and they are connected at their convergent top portion by a reinforcing portion 3 shaped in the manner of a wax drop which in the same time forms a wearing surface which can be smooth or, conversely, roughened. The thickness of the arms 2 of each pyramid is determined in function of the stiffness that must have the grating must have with respect to the loads to which it will be submitted in use.

The plate 1 includes on two sides connecting members 4 formed between two longitudinal walls 5 and 6 and transverse walls 7 aligned with the base of the pyramids.

It is advantageous that the connecting members 4 have a trapezoidal cross-section, the small base of the trapezium being at the upper part of the connecting members. It is also advantageous that slots 8 be provided at a certain height in the longitudinal wall 6. The connecting members 4 are preferably shaped along two adjacent sides of the plate but they could be formed on two opposed sides without departing from the scope of the invention.

Each plate has its two other sides provided with hook-shaped lugs 9 which extends from a shoe 10.

As shown in FIGS. 3 and 4, for assembling two plates, 1*a*, 1*b* it suffices to place them obliquely one with respect to the other for engaging the lugs 9 in the connecting members 4 while distorting advantageously in a slight manner the outer longitudinal wall 6 of the connecting members, which is facilitated by the slots 8. Then, the two plates 1*a*, 1*b* thus assembled are brought into a same plane as shown by FIG. 4. FIG. 4 shows that forces tending to separate the two plates 1*a*, 1*b* would tend to make the lugs to pivot in the direction of the arrow $f_1$ and, consequently, it would result thereby that the base of these lugs would be maintained against the base of the outer side of the connecting members 4 while the hook-shaped portion would cover the top of the inner wall of said connecting members.

If there is provided that the hook-shaped end of the lugs 9 be slightly distortable, it is then possible not to have the slots 8 and the positioning of the hooks can be provided by exerting a small pressure on the side delimiting the connecting members of a plate on the hooks of the adjacent plate.

Figure 5:
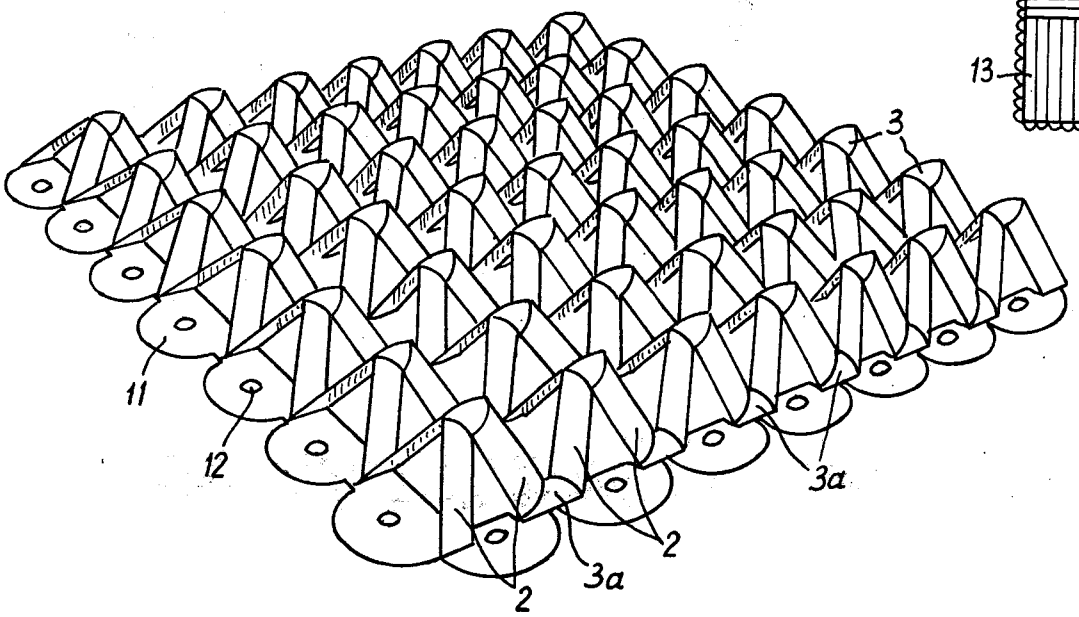
FIG. 5 is a perspective view of a plate showing a variant of embodiment of FIGS. 1 and 2.

FIG. 5 illustrates a small variant of embodiment according to which the arms 2 of the adjacent pyramids are connected to their lower part by a reinforcement 3*a* which is quite similar to the reinforcement 3 forming a wearing surface. This embodiment makes possible to provides grating plates of which the two sides are similar and which are particularly strong while still being flexible.

FIG. 5 shows also that other fixing means can be used for the fixation of adjacent plates. For example, the plates can be provided, at the bottom of the arms 2 forming the various pyramids and on all their sides, with protruding ears 11 bored with holes 12 for passing pins, locks, stapples or other fixing components which are positioned after the ears 11 of a plate have being brought to cover the ears of the adjacent plate.

Figure 6:
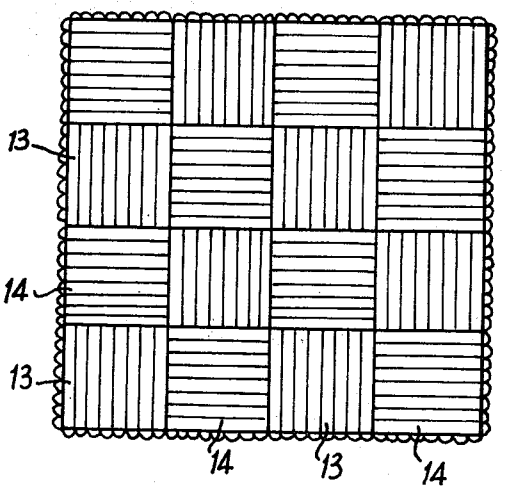
FIG. 6 is a diagrammatic plane view of a grating plate made according to another variant of the invention.

FIG. 6 illustrates a grating plate according to a variant of the invention, the plate being made of pyramidal elements substantially formed to be fixed together while forming kind of draught-board or checker-board with alternate squares 13, 14, the rows of which are respectively placed at right-angles. This arrangement has for its effect to considerably increase the resistance to crushing of the plate. Assembling the plates of FIG. 6 is provided by one of the means described in the above disclosure.

Figure 7:
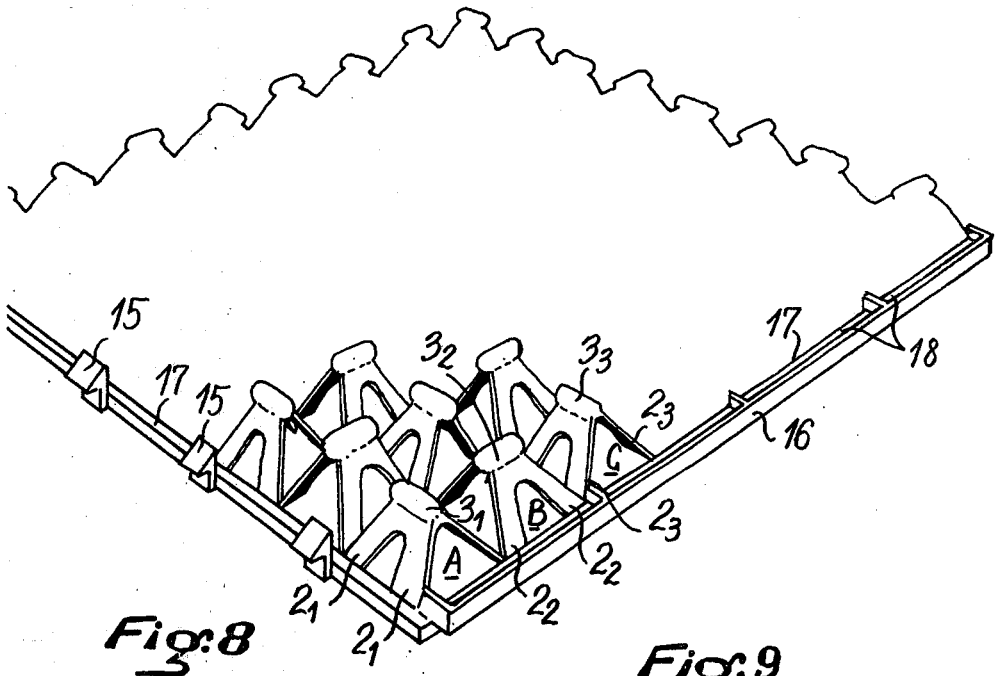
FIG. 7 is a partial perspective view of a variant of a plate according to the invention.
Figure 8:
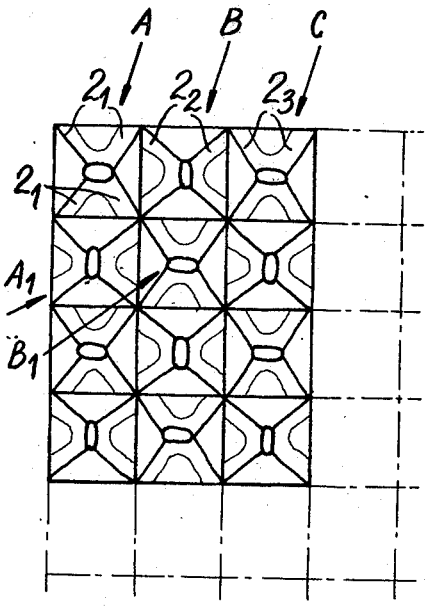
FIG. 8 is a partial plane view corresponding to FIG. 7.
Figure 9:
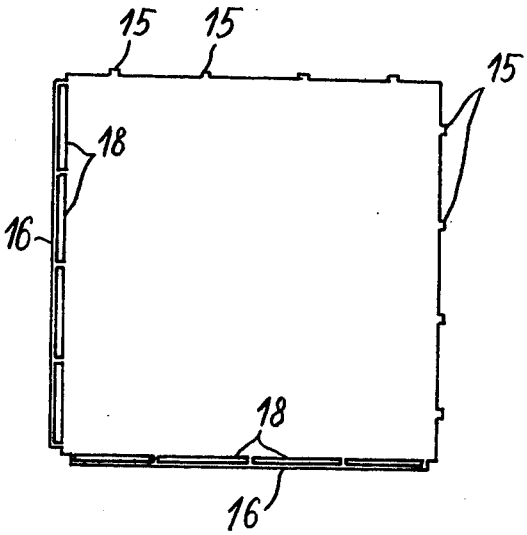
FIG. 9 is a diagrammatic plane view showing the position of the fixing elements of adjacent plates.

According to the variant of the embodiment of FIGS. 7–9, the successive pyramids are turned by 90° with respect to adjacent ones. There is actually seen, both in FIG. 7 and in FIG. 8 that the arms $2_1$ of the pyramid A as well as the rice-grain shaped reinforcement $3_1$ are shifted by $\pi/2$ with respect to the arms $2_2$ of the pyramid B which are themselves shifted by $\pi/2$ with respect to the arms $2_3$ of the pyramid C. It is the same with respect to the rice grain shaped reinforcement $3_2$ and $3_3$ of the pyramids B and C.

Looking at the drawings in the other direction, there is seen that the same arrangement is found again between the pyramid A and the pyramid $A_1$, between the pyramid B and the pyramid $B_1$ and so on.

The above described arrangement enables to give to a plate assembly a resistance which is particularly uniform with respect to both vertical forces and oblique forces, since these forces are almost necessarily applied on a plurality of reinforcing parts 3, and therefore on the arms of pyramids facing one direction and the other.

For enabling an easy connection together of a plurality of plates, it is advantageous, as shown in FIGS. 7 and 9, to provide two of the sides of each plate with hooks 15 and to provide the two other sides of the same plates with raised bars 16 forming kinds of gussets 18 together with the side edge 17 of the plate, the bars 16 being slightly resilient.

It is easy to introduce the hooks 15 of an adjacent plate into the gussets 18 in order that these hooks will then span or straddle the edge 17, the width of the hooks 15 being smaller than the length of the gussets 18 of the adjacent plates which can then be respectively shifted, and it is even possible that a same plate be connected to two other aligned plates when it is desired to realise an alternate mounting of the plates.

The plates can easily be made by moulding a synthetic resin since all the elements are tapered. It is also possible to make the plates of metal either by a moulding process or by a stamping process. It is further possible to manufacture the plates with a bio-degradable material, for example agglomerated fibers, iron, etc., for various applications, typically for the provisional retention of grounds.

I claim:

1. A grating comprising a plurality of plates made of an assembly of molded pyramidal elements arranged according to orthogonal lines and rows, each of said pyramidal elements being formed by thin arms, said arms having tops connected by an elongated and substantially wax-drop shaped reinforcing part and said arms having respective bottoms connected to bottoms of adjacent pyramidal elements, and each said plate further having lateral walls provided with means for assembling said plurality of plates together.

2. A grating according to claim 1, wherein each plate has four sides and said means for assembling comprise two connecting members on two of the sides of each plate and hook forming lugs on the two other sides of each plate protruding from a shoe, said lugs passing through said connecting members and protruding from said connecting members to bear on the shoe of the lugs of an adjacent plate.

3. A grating according to claim 2, wherein the connecting members have a substantially trapezoidal shape, their width being smaller than that of the hooks at least on one part of their height.

4. A grating according to claim 2, wherein one wall of said connecting members is provided with slots for giving a resilient flexibility to this wall.

5. A grating according to claim 1, wherein at least one of the wax-drop shaped reinforcing parts is roughened and form an anti-skidding means.

6. A grating according to claim 1, wherein the thin arms of the pyramidal elements are connected together in the vicinity of their top.

7. A grating according to claim 1, wherein each said plate has four sides and is provided on two of its said sides with hooks protruding from a peripheral edge and on its other two said sides with bars raised from a peripheral edge and forming with said edge elongated gusset means for housing hooks of at least one adjacent plate.

8. A grating according to claim 1, wherein mutually adjacent ones of said pyramidal elements are respectively shifted by 90° so that the arms and the reinforcing parts of adjacent ones of said pyramidal elements are shifted by 90°.

9. A grating according to claim 1, wherein adjacent ones of said plates are respectively shifted by 90°.

10. A grating according to claim 1, wherein the plates are each made of synthetic resin.

11. A grating according to claim 1, wherein the plates are each made of metal.

12. A grating according to claim 1, wherein the plates are each made of biodegradable material.

13. A grating according to claim 1, wherein the means for assembling comprises ear forming parts protruding on lateral sides of each plate and delimiting means for positioning fixing components.

14. A grating according to claim 13, wherein said fixing components are staples.

15. A grating according to claim 13, wherein said fixing components are pins.

16. A grating according to claim 13, wherein said fixing components are posts.

* * * * *